United States Patent [19]

Fenstermaker

[11] Patent Number: 4,575,011

[45] Date of Patent: Mar. 11, 1986

[54] REDUCING ASH CONTENT OF LIGNITE

[75] Inventor: Roger W. Fenstermaker, Bartlesville, Okla.

[73] Assignee: Phillips Petroleum Company, Bartlesville, Okla.

[21] Appl. No.: 574,484

[22] Filed: Jan. 27, 1984

[51] Int. Cl.[4] ..... B02C 19/12

[52] U.S. Cl. ..... 241/1; 241/14; 241/21; 241/24

[58] Field of Search ..... 241/1, 14, 24, 27, 21

[56] References Cited

U.S. PATENT DOCUMENTS

| | | | |
|---|---|---|---|
| 143,745 | 10/1873 | Bradford | 241/14 X |
| 1,854,659 | 4/1932 | Lehmann | 241/14 |
| 2,189,711 | 2/1940 | Eigenbrot | 241/14 |
| 2,842,319 | 7/1958 | Reerink et al. | 241/14 |

OTHER PUBLICATIONS

"Chemical Engineering Handbook", 1973, pp. 8–12 to 8–24.

Richards et al., *Textbook of Ore Dressing,* McGraw-Hill, 1940, pp. 114–127.

Leonard, "Coal Preparation", sponsored by AIMM & PE, New York, 1968.

Taggart, *Handbook of Mineral Dressing,* John Wiley & Sons, New York, 1945, pp. 10–11 to 10–10 & 4–55 to 4–59.

Walker et al., *Principles of Chemical Engineering,* McGraw-Hill, New York, 1937, pp. 268–271.

"Hackh's Chemical Dictionary", 1969, pp. 163, 164 and 389.

*Primary Examiner*—Mark Rosenbaum

*Attorney, Agent, or Firm*—A. W. Umphlett

[57] ABSTRACT

Mine-run lignite having an unsalably high content of ash-producing clay is treated selectively to shatter the more friable portions; the effluent from the shattering operation is classified by size; at least the classification containing the smallest particles is discarded; and particles of size larger than those discarded are combined to produce a mixture of lower ash producing clay content. Preferably, the classified effluent is separated into a first portion containing the larger, salable particles; a second portion containing medium-size particles which contains too much clay to be readily salable with the medium-size particle mixture subjected to further treatment such as jigging or heavy media separation to yield a product of clay content that is salable; and a third portion of smaller size particles which is discarded.

14 Claims, 3 Drawing Figures

REDUCING ASH CONTENT OF LIGNITE

BACKGROUND OF THE INVENTION

Figure 1:
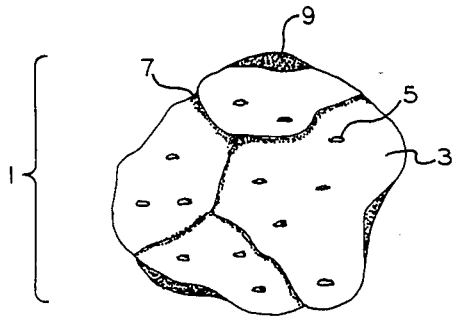

This invention relates to the treatment of lignite containing ash-producing clay. In another of its aspects, this invention relates to methods for separating lignite from the more friable clay with which it is associated as mined. In another of its aspects this invention relates to the classification of mine-run lignite to provide a product suitable for use, a product suitable for use after further treatment, and a waste product for disposal.

In some areas of this country, large reserves of lignite have been found that would support mine-mouth, electric generating plants. Large scale open-pit mining would be considered the proper method for using these reserves; however, in some areas of the reserves, where seams are thin or discontinuous, the avoidance of clay contamination of the lignite would be difficult when using the large-scale excavation equipment necessary for economical development of the reserves.

Extraneous clay material is classified as ash in a power plant assay and serves to reduce both the heating value and market value per ton of the mined lignite. Enhancement of the market value of high ash, low-BTU lignite can be accomplished through beneficiation operations which reduce the clay content. The concept of this invention provides a method by which mine-run lignite of relatively high clay contamination can be treated to reduce the ash content and thereby produce a more salable and useful product.

The invention is based on a process which selectively shatters friable, high-ash containing lignite along clay seams thereby exposing and breaking up the clay which is more friable than the carbonaceous lignite to produce clay particles generally smaller than the lignite particles. This allows further treatment for separation of the lignite and clay to upgrade the percentage of lignite in the mixture of materials.

It is therefore an object of this invention to provide a method for reducing the clay content of a heterogeneous mixture of mine-run lignite containing clay. It is another object of this invention to provide a combination of treatments to separate clay from lignite containing clay. It is still another object of this invention to provide a method for treating lignite particles containing clay seams and/or clay attached to the lignite surfaces preferentially to shatter the particles along the more friable clay portions of the particle.

Other aspects, objects and the various advantages of this invention will become apparent upon reading the specification and the appended claims.

STATEMENT OF THE INVENTION

According to this invention a method is provided for producing low-clay lignite from heterogeneous, mine run lignite of higher clay content. The mine run lignite is subjected to sufficient agitation selectively to shatter the more friable portions of the particles, the effluent from the agitation operation is classified by size, at least the classification containing the smallest particles is discarded, and particles of size larger than those discarded are combined to produce a low-clay mixture.

In a further embodiment of the invention the classification effluent is recombined into cuts so that a mixture of the largest-size particles is obtained having an overall clay content in the range of about 12 to about 13 percent by weight dry. A second cut of the next larger-size particle classification having combined an overall clay content in the range of about 17 to about 25 percent by weight dry is obtained, and a third cut which is the remaining material which contains the smallest-size particles is separated for removal as a waste product.

In a further embodiment of the invention the second cut of classified effluent from an agitated classification process is further treated by a process such as jigging or media separation to yield a product having clay content in the range of about 12 to about 13 percent by weight which can then be recombined with the first cut as a more commercially desirable material.

For the purpose of this invention the shattering process is a form of "selective crushing" which is the providing of sufficient agitation to grind or shatter the "softer" particles, i.e., those having surface inclusions of clay or held together with clay seams, while the agitation is not sufficient to break apart the "harder" particles of lignite. There is, therefore, no attempt to remove the intrinsic or chemically bound ash producing matter within the lignite particles.

Various methods lend themselves to the "selective crushing". Among others are: (a) a high-shear drive for agitating a lignite-water slurry as illustrated by a blender having blunt paddles or a rotating chain as agitator; (b) jets of gas, preferably air, or liquid, preferably water, directed against the lignite; (c) controlled impacting of the lumps against each other or a hard surface using a tumbling action or air pressure; (d) grinding equipment that provides a controlled pressure between the grinding surfaces; and (e) treating a lignite/liquid slurry with ultrasonic energy. Each of these methods can be optimized to provide less crushing of harder pieces of lignite while shattering the "softer" or more friable particles.

For the purposes of this invention the selective crushing must be coupled with a classification of the crushed particles. This is best carried out as a sized washing process such as sieving or, for a commercial operation, jigging tables or any of the hydraulic classification methods known in the art can be used.

Figure 2:
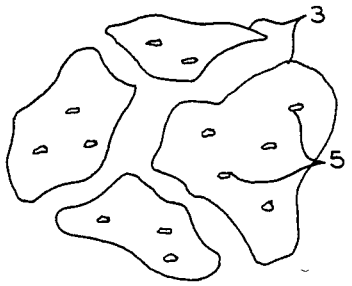
Figure 3:
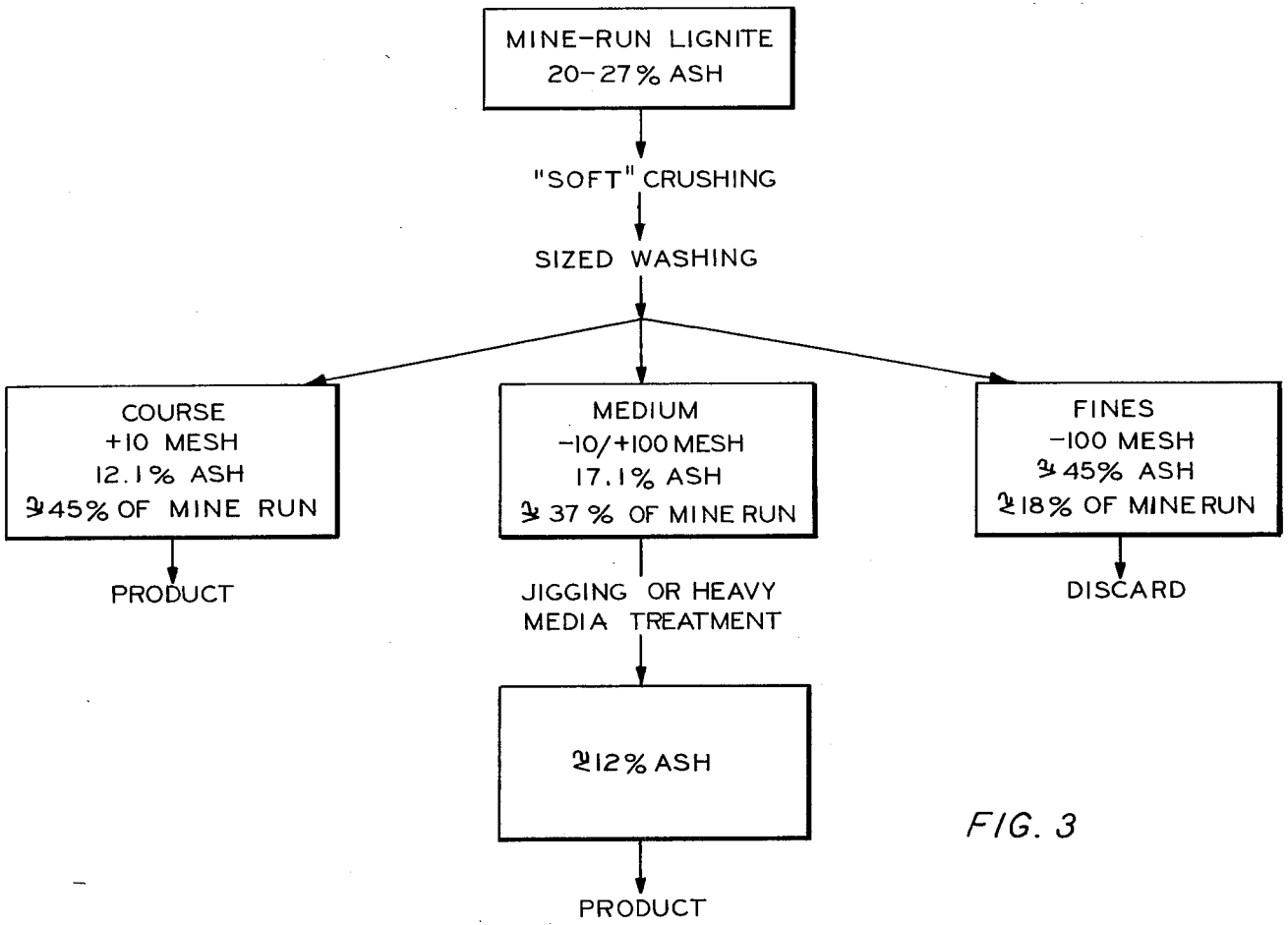

The invention can best be understood as discussed in conjunction with an exemplification illustrated by reference to the drawing. In the drawing:

FIG. 1 shows an original lump of lignite of the type that can be treated by this invention, FIG. 2 shows the same lump after beneficiation, and FIG. 3 is a schematic representation of a process of this invention.

Referring now to FIG. 1 a large particle or lump (1) suitable for treatment by the process of this invention is shown. The lump is made up of smaller particles of hard carbon (3) which can have inclusions of intrinsic clay (5). The particles of hard carbon are held together by clay seams (7) and can have surface clay (9) attached to the outer boundaries of the lump.

According to the present process an object of the invention is selectively to shatter the more friable clay so that the clay seams (7) and the surface clay (9) are broken into smaller particles thereby releasing (as shown in FIG. 2) smaller hard carbon particles (3) from the original lump (1). The agitation is designed to minimize the fracturing of the hard carbon (3). The clay inclusions (5) within the individual hard carbon particles remain as contaminant, or ash producers, in the lignite beneficiation product.

Referring now to FIG. 3, an example of the process is offered in which a sample of mine-run lignite containing about 20 to about 27 percent ash, i.e., clay, is treated by the present process. The data presented were obtained by agitating approximately 380 grams of a lignite representative of mine-run material that had been initially crushed to a ½-inch top size. The agitation was carried out in a high-speed Waring blender containing 1800 grams of water. The blender was equipped with a sharp edge blade which was run at a rotational speed of 10,000 rpm for 1½ minutes. Upon completion of the agitation cycle, both the water and lignite were passed through a series of descending sieve sizes ranging from 4 mesh to 270 mesh. Each of the lignite sieve fractions was then surface dried at 40° C. for 24 hours, ground to 60 mesh size, and the residual was dried to a constant weight at 104°-110° C. in accordance with ASTM standards. After weighing each dried fraction, representative analysis samples were obtained by successive riffling. Analysis samples from each sieve fraction were then subjected to ash analysis. The weight of the original agitated sample, as well as its original ash, was determined by summing individual size fraction weights. The extraneous matter in the lignite samples was observed to be predominantly clay. It should be noted that it is contemplated with commercial equipment the size determinations would be made employing hydraulic classification rather than sieving.

Table I, below, sets out the classification data obtained in this experiment:

TABLE I

| Sieve | G. Dry Lignite | Accum. G. Lignite | % of Tot. Lignite | G. Dry Ash | Accum. G. Ash | % of Tot. Ash | % Ash in Sieve |
|---|---|---|---|---|---|---|---|
| +4 | 65.0 | 65.0 | 17.02 | 7.31 | 7.31 | 9.45 | 11.25 |
| −4/+6 | 33.4 | 98.4 | 25.77 | 3.92 | 11.23 | 14.52 | 11.74 |
| −6/+10 | 72.0 | 170.4 | 44.63 | 9.30 | 20.53 | 26.55 | 12.92 |
| −10/+14 | 34.1 | 204.5 | 53.56 | 5.40 | 25.93 | 33.54 | 15.84 |
| −14/+20 | 35.2 | 239.7 | 62.78 | 5.33 | 31.26 | 40.43 | 15.14 |
| −20/+40 | 39.7 | 279.4 | 73.18 | 6.71 | 37.97 | 49.10 | 16.90 |
| −40/+60 | 20.9 | 300.3 | 78.65 | 3.93 | 41.90 | 54.19 | 18.80 |
| −60/+100 | 12.0 | 312.3 | 81.80 | 2.87 | 44.77 | 57.90 | 23.92 |
| −100 | 69.5 | 381.8 | 100.00 | 32.55 | 77.32 | 100.00 | 46.83 |

Overall % Ash in Sample = [77.32 ÷ 381.8] 100 = 20.25%

The great value of the soft crushing technique can be seen in the table above. The coarser fractions are quite low in ash; 45 percent of the product is coarser than 10 mesh and contains only 12.1 percent ash. It appears that the primary effect of the blender is to decrease the amount of material in the larger sizes by the preferential breakup of the high-ash pieces. This has two distinct, but related advantages.

The first obvious advantage is that almost half of the weight of the sample has been segregated and concentrated directly into a more valuable product. Using the value of 26.8 percent for the ash content of the seam from which the material came, we have a dry basis heat content of 8,900 BTU/lb. By contrast, the 12 percent ash material contains 10,900 BTU/lb, and the −100 mesh 46.8 percent ash material, less than 6,000 BTU/lb. Since the value of the coal is closely related to BTU content, a much more valuable product has been obtained by this method. The second advantage is that the material finer than 10 mesh which contains more than 73 percent of the ash has been segregated for further treatment. After discard of the −100 mesh material, the remaining cuts between 10 and 100 mesh contain 37 percent of the original material and an average of 17.1 percent ash. The density separations described below illustrate how this latter −10/+100 mesh material can be upgraded into a product equal in quality to the +10 mesh material.

The importance of the selective crush has been shown to be that it separates the sample into a portion that can be sold directly (approximately 45 percent), one that can be discarded immediately (approximately 18 percent), and a 37 percent remainder that can be effectively upgraded by additional treatment. The portion of the material that needs extensive heavy media treatment or jig stratification for beneficiation has been reduced by almost a factor of 3. In a mined run of such heterogeneous material, these proportions will vary from time to time. The data above show, however, that the selective crushing and screening has the built in flexibility to separate the lignite automatically into three fractions as mentioned above regardless of their relative abundance in any given mine-run material.

The difference in density between lignite (1.1-1.2 g/cc) and common mineral impurities (typically 2.2 g/cc or greater) suggests that a liquid with an intermediate density such as $CCl_4$ at 1.58 g/cc would readily separate the "casual" minerals from the lignite. Many commercial processes for ore beneficiation make use of heavy liquids, usually halogenated hydrocarbons, for this type of separation. For less valuable minerals such as coal, the dense medium is often a suspension of clay in water. More often, the action of the heavy media is approximated by jigging tables. These are high-throughput devices which use mechanical shaking to cause the coal/mineral mixture to stratify into layers according to density.

Information necessary for the most efficient use of this invention with a given lignite is the extent to which the lignite and ash are bound together and what size particles are involved. Obviously, the mine run must be crushed to a size such that the coal and mineral particles are generally broken apart from each other before jigging or heavy media separation will work. A complete set of determinations of the ash concentrations for the float and sink fractions for the lignite as a function of the initial particle size and of the density of the heavy medium is required for a given lignite. These numbers, known as washability data, enable commercial manufacturers of coal-cleaning machinery to estimate the cost/benefit of this kind of treatment of the lignite.

I claim:

1. A method for producing a low-ash lignite from heterogeneous, mine-run lignite of higher ash content, said method comprising:

(a) agitating clay-containing, mine-run lignite sufficiently, selectively to shatter the clay seam portions which are the more friable portions;

(b) classifying by size the effluent from the agitation operation;

(c) recombining said classified effluent into cuts comprising:

(1) largest sized particles having an overall, combined clay content in the range of about 12 to about 13 percent by weight dry;

(2) middle-sized particles having an overall, combined clay content of about 13 to about 50 percent by weight dry; and (3) smallest sized particles having an overall, combined clay content greater than about 50 percent by weight dry, (d) separating each of said effluent cuts from the other effluent cuts;

(e) further treating said effluent cut (2) of middle-sized particles by a process of heavy media separation to yield a classified product having clay content in the range of about 12 to about 13 percent by weight dry;

(f) combining said effluent cut (1) of largest size particles and the classified product of treating the effluent cut (2); and (g) recovering the product of the combining of cuts of step (f) as low-ash lignite.

2. A method of claim 1 wherein the agitation selectively to shatter said more friable clay portions of said mine-run lignite is accomplished by (i) higher shear stirring.

3. A method of claim 1 wherein the agitation selectively to shatter said more friable clay portions of said mine-run lignite is accomplished by (ii) jet-wash screening.

4. A method of claim 1 wherein the agitation selectively to shatter said more friable clay portions of said mine-run lignite is accomplished by (iii) wet crushing.

5. A method of claim 1 wherein the agitation selectively to shatter said more friable clay portions of said mine-run lignite is accomplished by (iv) gas blasting.

6. A method of claim 1 wherein the agitation selectively to shatter said more friable clay portions of said mine-run lignite is accomplished by (v) ultrasonic treatment of slurry.

7. A method of claim 1 wherein the agitation selectively to shatter said more friable clay portions of said mine-run lignite is accomplished by (vi) controlled impacting.

8. A method for producing a low-ash lignite from heterogeneous, mine-run lignite of higher ash content, said method comprising:

(a) agitating clay-containing, mine-run lignite sufficiently, selectively to shatter the clay seam portions which are the more friable portions;

(b) classifying by size the effluent from the agitation operation;

(c) recombining said classified effluent into cuts comprising:

(1) largest sized particles having an overall, combined clay content in the range of about 12 to about 13 percent by weight dry;

(2) middle-sized particles having an overall, combined clay content of about 13 to about 50 percent by weight dry; and (3) smallest sized particles having an overall, combined clay content greater than about 50 percent by weight dry (d) separating each of said effluent cuts from the other effluent cuts;

(e) further treating said effluent cut (2) of middle-sized particles by a process of jigging to yield a classified product having clay content in the range of about 12 to about 13 percent by weight dry;

(f) combining said effluent cut (1) of largest size particles and the classified product of treating the effluent cut (2); and (g) recovering the product of the combining of cuts of step (f) as low-ash lignite.

9. A method of claim 8 wherein the agitation selectively to shatter said more friable clay portions of said mine-run lignite is accomplished by (i) high shear stirring.

10. A method of claim 8 wherein the agitation selectively to shatter said more friable clay portions of said mine-run lignite is accomplished by (ii) jet-wash screening.

11. A method of claim 8 wherein the agitation selectively to shatter said more friable clay portions of said mine-run lignite is accomplished by (iii) wet crushing.

12. A method of claim 8 wherein the agitation selectively to shatter said more friable clay portions of said mine-run lignite is accomplished by (iv) gas blasting.

13. A method of claim 8 wherein the agitation selectively to shatter said more friable clay portions of said mine-run lignite is accomplished by (v) ultrasonic treatment of slurry.

14. A method of claim 8 wherein the agitation selectively to shatter said more friable clay portions of said mine-run lignite is accomplished by (vi) controlled impacting.

* * * * *